US009799502B2

(12) United States Patent
Kenny

(10) Patent No.: US 9,799,502 B2
(45) Date of Patent: Oct. 24, 2017

(54) APERTURE GAS FLOW RESTRICTION

(71) Applicant: Micromass UK Limited, Wilmslow (GB)

(72) Inventor: Daniel James Kenny, Knutsford (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/880,711

(22) Filed: Oct. 12, 2015

(65) Prior Publication Data

US 2016/0035554 A1 Feb. 4, 2016

Related U.S. Application Data

(63) Continuation of application No. 14/123,537, filed as application No. PCT/GB2012/051254 on Jun. 1, 2012, now Pat. No. 9,159,541.

(60) Provisional application No. 61/497,300, filed on Jun. 15, 2011.

(30) Foreign Application Priority Data

Jun. 3, 2011 (GB) ..... 1109383.8

(51) Int. Cl.

| | |
|---|---|
| ***H01J 49/04*** | (2006.01) |
| ***H01J 49/26*** | (2006.01) |
| ***H01J 49/06*** | (2006.01) |
| ***H01J 49/24*** | (2006.01) |

(52) U.S. Cl.

CPC ..... *H01J 49/0495* (2013.01); *H01J 49/0418* (2013.01); *H01J 49/062* (2013.01); *H01J 49/067* (2013.01); *H01J 49/24* (2013.01)

(58) Field of Classification Search

CPC .. H01J 49/0495; H01J 49/0418; H01J 49/062; H01J 49/067; H01J 49/24; H01J 49/26

USPC ..... 250/281, 282, 283

See application file for complete search history.

(56) References Cited

U.S. PATENT DOCUMENTS

| | | | |
|---|---|---|---|
| 4,740,692 | A | 4/1988 | Yamamoto et al. |
| 6,511,850 | B1 | 1/2003 | Vigh et al. |
| 7,230,234 | B2 | 6/2007 | Kobayashi |
| 7,696,495 | B2 | 4/2010 | Mack et al. |
| 7,743,790 | B2 | 6/2010 | Howard |

(Continued)

FOREIGN PATENT DOCUMENTS

| | | |
|---|---|---|
| JP | 09210965 | 8/1997 |
| JP | 2000251831 | 9/2000 |
| WO | 2009031179 | 3/2009 |

OTHER PUBLICATIONS

Benedikt et al., "*Molecular Beam Sampling System With Very High Beam-to-Background Ratio: The Rotating Skimmer Concept*", Review of Scientific Instruments, vol. 80, No. 5, pp. 55107-55107-4, 2009.

*Primary Examiner* — Nicole Ippolito

(74) *Attorney, Agent, or Firm* — Diederiks & Whitelaw, PLC

(57) ABSTRACT

A mass spectrometer is disclosed comprising two vacuum chambers maintained at different pressures. The two vacuum chambers are interconnected by a differential pumping aperture. The effective area of the opening between the two vacuum chambers may be varied by rotating a disk having an aperture in front of the differential pumping aperture so as to vary the gas flow rate through the opening and between the two chambers.

16 Claims, 4 Drawing Sheets

(56) References Cited

U.S. PATENT DOCUMENTS

| | | | | |
|---|---|---|---|---|
| 8,003,938 | B2 | 8/2011 | Brekenfeld | |
| 9,159,541 | B2 * | 10/2015 | Kenny | H01J 49/067 |
| 2004/0007666 | A1 * | 1/2004 | Griffey | H01J 49/0077 250/282 |

* cited by examiner

FIG. 2α

APERTURE GAS FLOW RESTRICTION

CROSS-REFERENCE TO RELATION APPLICATION

This application is a continuation application of U.S. patent application Ser. No. 14/123,537, filed 3 Dec. 2013, which is the National Stage of International Application No. PCT/GB2012/051254, filed 1 Jun. 2012, which claims priority from and the benefit of U.S. Provisional Patent Application Ser. No. 61/497,300 filed on 15 Jun. 2011 and United Kingdom Patent Application No. 1109383.8 filed on 3 Jun. 2011. The entire contents of these applications are incorporated herein by reference.

BACKGROUND OF THE PRESENT INVENTION

The present invention relates to apparatus and methods for controlling the gas flow between two chambers in a mass spectrometer. According to an embodiment one or both of the chambers may comprise a vacuum chamber. Mass spectrometers often contain different regions or chambers which are at different levels of vacuum. For example, a mass spectrometer may comprise a quadrupole mass filter ("QMF") which resides in a chamber at a pressure of approx. $1\times10^{-6}$ mbar and which is followed by a collision cell at a pressure of approx. $1\times10^{-3}$ to approx. $1\times10^{-2}$ mbar. This in turn may be followed by a Time of Flight ("TOF") mass analyser which may be operated at a pressure of $<1\times10^{-6}$ mbar.

Between these different regions there is normally an opening or differential pumping aperture which acts to limit the flow of gas from one chamber to another and through which ions must pass if they are to traverse the mass spectrometer. These openings are generally manufactured to be as thin as possible, typically 0.5 mm to 1.0 mm, so as to minimise loss of ion transmission as ions pass through the orifice. The thicker the opening is the more likely it is that some ions will strike the inner wall of the opening as they pass through the orifice and be lost.

Reducing the size of an opening (i.e. the diameter of a circular hole or the length of a slit) reduces the gas flow through it, which in turn reduces the quantity of vacuum pumping that is required to maintain the desired pressure in the different regions. This is particularly important in situations where there is a large pressure differential between vacuum chambers and hence a large gas flow, or where a small, lightweight or portable instrument is desired. However, reducing the size of an orifice makes it more difficult to focus ions through it. This can lead to ions no longer being able to pass through the orifice which in turn reduces the transmission and hence sensitivity of the mass spectrometer.

It is known to use a valve to reduce the gas flow into the initial vacuum chamber of a mass spectrometer from the atmosphere.

It is desired to provide an improved mass spectrometer and method of mass spectrometry.

SUMMARY OF THE INVENTION

According to an aspect of the present invention there is provided a mass spectrometer comprising:

two chambers to be maintained at different pressures in use, wherein the two chambers are interconnected by an opening for transmitting ions from one of the chambers to the other of the chambers; and a means or first device for varying the area of the opening so as to vary the gas flow rate through the opening and between the chambers in use.

At least one or both of the chambers are preferably connected to a vacuum pump for maintaining the chambers at the different pressures. One or both of the chambers preferably comprise a vacuum chamber. However, other less preferred embodiments are contemplated wherein one or both of the chambers comprise housings within a vacuum chamber. For example, the device according an embodiment of the present invention may be located at the entrance to an ion mobility spectrometer and/or a gas collision or reaction cell within a vacuum chamber.

According to the preferred embodiment the opening comprises a differential pumping aperture between two vacuum chambers. According to an embodiment the opening comprises a gas limiting aperture between two chambers.

The mass spectrometer is preferably configured such that ions are transmitted towards and through the opening when the opening has a large area and ions are preferably prevented from being transmitted towards and through the opening when the opening has a relatively smaller area.

A high gas flow rate is preferably permitted between the chambers when the area of the opening is large and a low gas flow rate is preferably permitted between the chambers when the area of the opening is smaller.

The mass spectrometer or a control system of the mass spectrometer is preferably configured to vary the area of the opening such that at a first time the area of the opening is preferably set to permit gas to flow between the chambers, and at a second time the opening is preferably closed or reduced so as to substantially prevent or reduce gas from passing between the chambers.

The area of the opening is preferably repeatedly increased and decreased or varied.

The area of the opening is preferably repeatedly increased and decreased or varied in a continuous or periodic manner.

The mass spectrometer preferably further comprises an ion guide in one of the chambers which is preferably arranged to guide or focus ions towards the opening so that ions pass through the opening and into the other chamber.

The mass spectrometer preferably further comprises a second device for pulsing ions towards and through the opening. The second device is preferably synchronised with the opening such that ions are pulsed through the opening when the opening is of relatively large area and ions are preferably not pulsed through the opening when the opening is of relatively small area or is closed.

The second device preferably comprises a pulsed ion source or an ion trap.

The two chambers are preferably separated by a wall and the opening preferably comprises an orifice in the wall.

The wall generally preferably has a uniform thickness, but preferably has a reduced thickness in a portion thereof, and wherein the orifice is preferably provided through the portion of the wall having the reduced thickness.

The opening preferably comprises an orifice in a wall between the chambers and the mass spectrometer preferably further comprises an orifice occlusion member, the orifice occlusion member being movable relative to the orifice so as to cover the orifice by varying amounts and thus change the area of the opening by corresponding varying amounts.

The orifice occlusion member is preferably formed by a plate.

The orifice occlusion member preferably comprises at least one aperture and a non-apertured portion, and wherein the orifice occlusion member is arranged and adapted such that it is movable between a position where the aperture is relatively more aligned with the orifice so as to increase the area of the opening and a different position wherein the aperture less aligned with the orifice so as to decrease the area of the opening.

The orifice occlusion member preferably comprises at least one aperture and a non-apertured portion, and wherein the orifice occlusion member is arranged and adapted such that it is movable between a position where the non-apertured portion covers the orifice to close the opening, and a different position wherein the aperture is at least partially aligned with the orifice such that gas and/or ions can pass through the opening.

The orifice occlusion member is preferably rotated or rotatable into position. According to an embodiment the orifice occlusion member may be rotated in a continuous or stepped manner about an axis so as to move between the positions.

According to another embodiment the opening may be provided by an iris, the opening in the iris being variable in diameter.

The opening may according to another embodiment be provided by a deformable conduit and wherein the conduit is compressible or otherwise deformable so as to reduce the area of the opening through the conduit.

According to an aspect of the present invention there is provided a method of controlling the gas flow between two chambers in a mass spectrometer that are maintained at different pressures, wherein the two chambers are interconnected by an opening for transmitting ions from one of the chambers to the other of the chambers, the method comprising:

varying the area of the opening so as to vary the gas flow rate through the opening and between the chambers.

The present invention also provides a method of mass spectrometry comprising the above described method.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device or ion gate for pulsing ions; and/or (l) a device for converting a substantially continuous ion beam into a pulsed ion beam.

The mass spectrometer may further comprise either:

(i) a C-trap and an orbitrap (RTM) mass analyser comprising an outer barrel-like electrode and a coaxial inner spindle-like electrode, wherein in a first mode of operation ions are transmitted to the C-trap and are then injected into the orbitrap (RTM) mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the orbitrap (RTM) mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

It is a purpose of the preferred embodiment to produce an opening which separates two or more vacuum regions of a mass spectrometer, wherein the physical dimensions of the opening may be varied with time. This allows the time-averaged gas flow through the opening to be reduced.

An additional feature of a preferred embodiment is to provide an opening which is as thin as possible.

In a preferred embodiment of the present invention an ion storage device, such as an ion trap, is preferably provided upstream of the opening. The ion storage device may be used to transport ions through the opening when the opening is open, or at its maximum dimension, and to accumulate or otherwise prevent ions traversing the opening when it is closed, or at a reduced dimension.

BRIEF DESCRIPTION OF THE DRAWINGS

Various embodiments of the present invention together with other arrangements given for illustrative purposes only will now be described, by way of example only, and with reference to the accompanying drawings in which:

FIG. 2A shows an embodiment of the present invention wherein the opening comprises a thin orifice plate and the area of the opening is varied using a rotating disk in which there is a short slot and wherein the slot in the disk is aligned with the opening and FIG. 2B shows an embodiment of the present invention wherein the opening comprises a thin orifice plate and the area of the opening is varied using a rotating disk in which there is a short slot and wherein the slot in the disk is unaligned with the opening;

DETAILED DESCRIPTION OF PREFERRED EMBODIMENTS

Figure 1A:
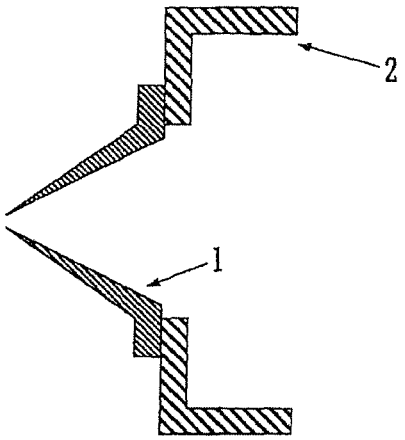
FIG. 1a PRIOR ART
FIG. 1A shows a cross-section of an opening in a conventional skimmer electrode of a mass spectrometer.
Figure 1B:
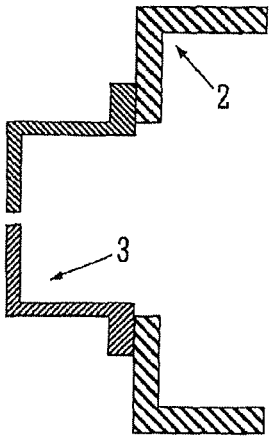
FIG. 1b PRIOR ART
FIG. 1B shows a cross-section of an opening in a conventional differential pumping aperture of a mass spectrometer and FIG. 1C shows a cross-section of an opening in a conventional sampling orifice of a mass spectrometer.
Figure 1C:
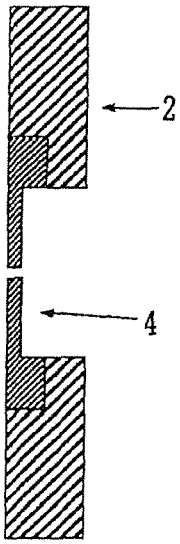
FIG. 1c PRIOR ART

Various different types of conventional ion inlets will first be briefly described with reference to FIGS. 1A-1C. FIG. 1A shows a cross-section of a conventional skimmer electrode 1 mounted on a vacuum housing 2. FIG. 1B shows a conventional differential pumping aperture 3 mounted on a vacuum housing 2. FIG. 10 shows a conventional sampling orifice 4 mounted on a vacuum housing 2. The conductance of these apertures and hence the gas flow through the apertures is dependent upon their radius as well as their depth/thickness.

A preferred embodiment of the present invention will now be described.

According to a preferred embodiment of the present invention a thin plate 5 is preferably provided having an orifice 5*a* as shown in FIG. 2A. The thin plate 5 is preferably mounted against a vacuum chamber 6 such that the only gas flow from one chamber to the other chamber is via the orifice 5*a* provided in the thin plate 5. The orifice 5*a* preferably comprises a differential pumping aperture although less preferred embodiments are contemplated wherein the orifice 5*a* is provided at the entrance to a housing within a vacuum chamber. For example, the orifice 5*a* may be provided at the entrance to an ion mobility spectrometer or a collision gas cell located within a vacuum chamber. It is not essential therefore that the orifice 5*a* separates two vacuum chambers, each vacuum chamber being pumped by a vacuum pump.

A spinning/rotating disk 7 is preferably provided in communication with the assembly comprising the thin plate 5 and the vacuum chamber 6. The spinning/rotating disk 7 preferably has a short aperture 7*a* which is preferably in the form of a slot.

FIG. 2A shows the preferred embodiment at a time when the slot 7*a* in the rotating disk 7 is aligned with the orifice 5*a* in the thin plate 5 so that ions may be transmitted through the differential pumping aperture formed by the orifice 5*a*.

Figure 2B:
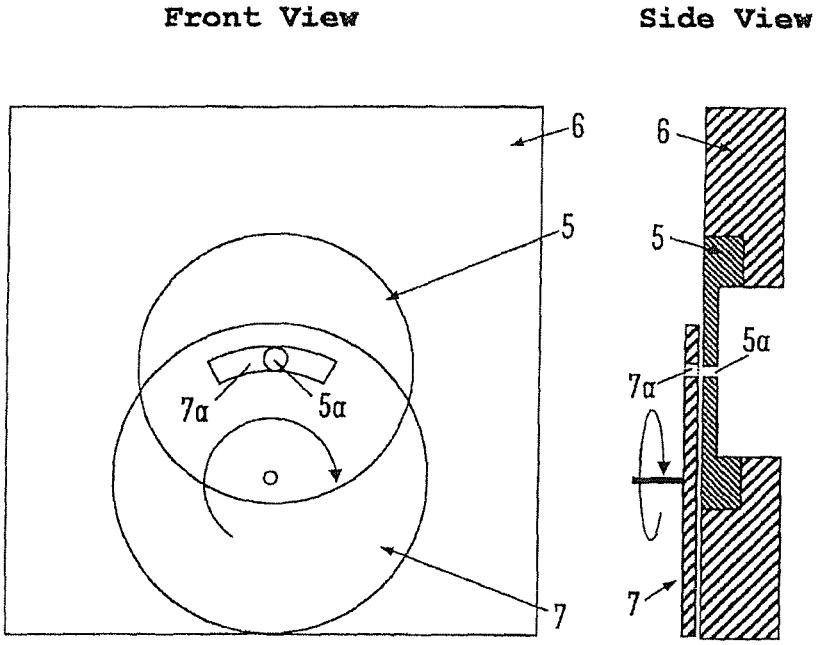
Figure 2B:
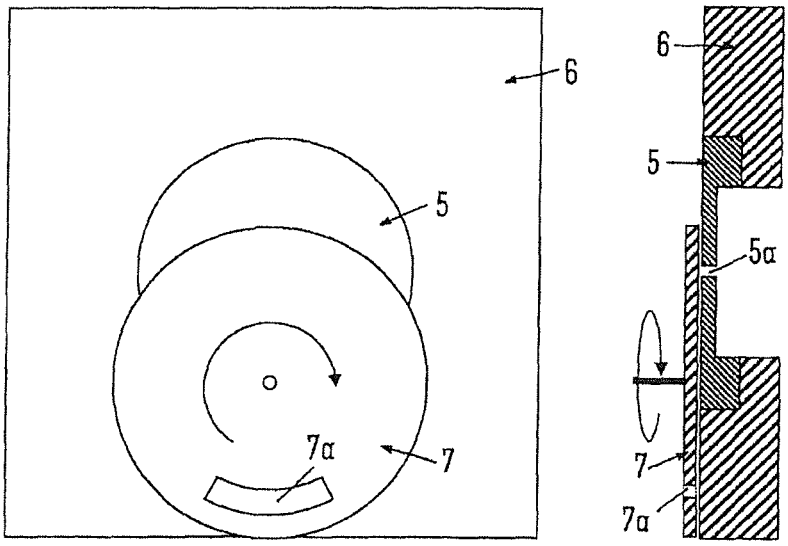

FIG. 2B shows the preferred embodiment of a time when the orifice 5*a* in the thin plate 5 is occluded by the non-apertured portion of the rotating disk 7. It is apparent that gas is only capable of passing through the orifice 5*a* from one chamber to the next when the slot 7*a* in the rotating disk 7 and the orifice 5*a* in the thin plate 5 are substantially aligned.

At times when the orifice 5*a* in the thin plate 5 is occluded by the rotating disk 7, no gas flow through the orifice 5*a* in the thin plate 5 is possible. By rotating the apertured disk 7 it is therefore possible to reduce the average gas flow through the orifice 5*a* between the chambers and hence reduce the vacuum pump requirements.

Figure 3A:
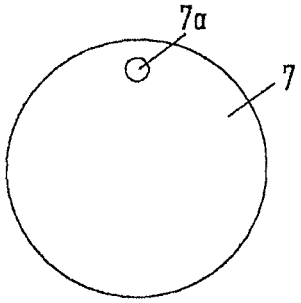
FIG. 3A shows an example of a rotating disk having a circular hole that may be used according to an embodiment of the present invention.
Figure 3B:
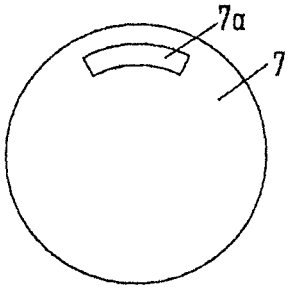
FIG. 3B shows an example of a rotating disk having a short slot that may be used according to an embodiment of the present invention.
Figure 3C:
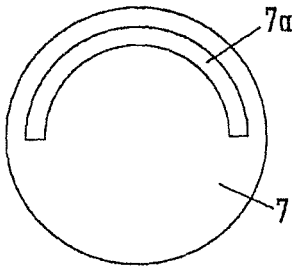
FIG. 3C shows an example of a rotating disk having a long slot that may be used according to an embodiment of the present invention and FIG. 3D shows an example of a rotating disk having multiple slots that may be used according to an embodiment of the present invention.
Figure 3D:
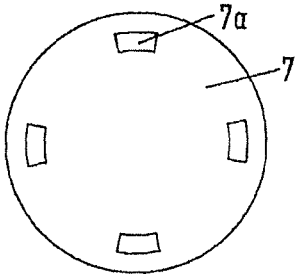

Various embodiments are contemplated wherein the apertured disk 7 may take forms other than that shown in FIGS. 2A and 2B. The apertured disk 7 may take the form as shown in FIGS. 3A to 3D. In FIG. 3A the aperture 7*a* in the disk 7 is in the form of a small hole. In FIG. 3B the aperture 7*a* in the disk 7 is in the form of a short slot. In FIG. 3C the aperture 7*a* in the disk 7 is in the form of a long slot. In FIG. 3D multiple apertures 7*a* are provided in the disk 7 in the form of multiple slots.

According to embodiments of the present invention the rotating disk 7 may not be flat.

According to embodiments of the present invention the rotating disk 7 may additionally and/or alternatively contain protuberances. For example, according to an embodiment the disk 7 may have a short tube or other type of aperture mounted upon it (instead of an aperture 7*a* in the disk 7).

Figure 4:
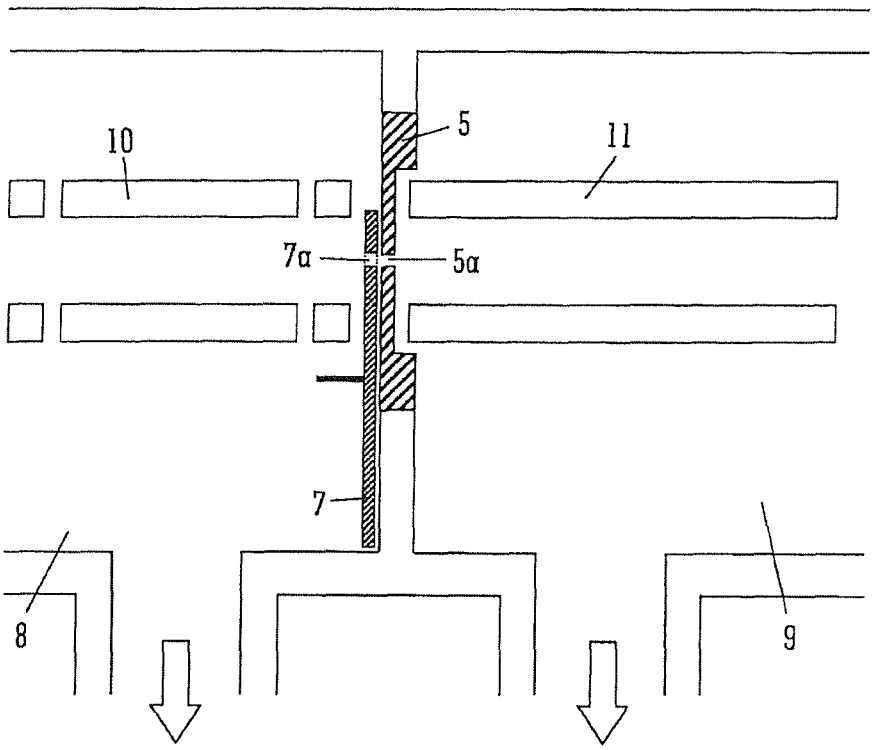
FIG. 4 shows an embodiment wherein the preferred device forms a differential pumping aperture between two vacuum chambers wherein an ion trap is located in an upstream vacuum chamber and a quadrupole rod set is located in a downstream vacuum chamber.

FIG. 4 shows an embodiment of the present invention showing a section of a mass spectrometer comprising a first vacuum chamber 8 and a second vacuum chamber 9. A linear ion trap 10 is located in the first vacuum chamber 8 and a quadrupole mass filter 11 is located in the second vacuum chamber 9.

A differential pumping aperture between the two vacuum chambers 8,9 is preferably provided by a thin plate 5 having an orifice 5*a* between the two vacuum chamber 8,9. A rotating disk 7 having an aperture 7*a* is preferably provided adjacent the thin plate 5. The disk 7 may be rotated so as to vary the area of the effective gas flow aperture between the two vacuum chambers 8,9.

The linear ion trap 10 may be used to accumulate ions whilst the orifice 5*a* is occluded by the disk 7 and may then be arranged to pulse ions through the orifice 5*a* once the disk 7 is moved or rotated to align the aperture 7*a* in the disk 7 with the orifice 5*a* in the thin plate 5. Advantageously, the gas flow is preferably reduced and the number of ions and hence the sensitivity of the instrument is preferably maintained.

Further embodiments are contemplated wherein the preferred device may be used with a pulsed ion source, such as a MALDI ion source. The pulsed release of ions is preferably synchronised with the rotation of the disk 7 and the opening of the orifice 5*a*. An optical encoder or similar device may be used to accurately locate the position of the disk 7.

It is also contemplated that instead of continuous rotation of the disk, the opening through the orifice 5*a* may be temporarily set to a fixed open or closed state, for example, whilst the instrument is not being used.

The present invention is not limited to a rotating disk occlusion member. Other embodiments are contemplated wherein a linear element may be moved vertically and/or horizontally in front of the orifice 5*a*.

In alternative embodiments, the opening may comprise an iris or other mechanical device or assembly which when operated alters the physical dimension of the opening. Alternatively, the opening may comprise a plastic/elastic tube which is squashed or otherwise deformed to vary the area of the opening.

It is also contemplated that the opening of the aperture 5*a* may be synchronised with a downstream ion trap. For example, the opening 5*a* may only be opened for a defined fill-time to fill the downstream ion trap with either a predetermined number of ions or for a predetermined length of time.

The preferred embodiment may also be used with collision/gas cells or with ion mobility spectrometers to limit the gas flow.

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising:

two chambers to be maintained at different pressures in use, wherein the two chambers are interconnected by an opening for transmitting ions from one of the chambers to the other of the chambers;

a first device for varying the area of the opening so as to vary the gas flow rate through the opening and between the chambers in use; and an ion storage device downstream of said opening, wherein said ion storage device is synchronised with said opening such that ions are transmitted through said opening into said ion storage device when the opening has a large area and ions are prevented from being transmitted through said opening into said ion storage device when the opening has a relatively smaller area or is closed, wherein said first device is arranged and adapted to fill said ion storage device for a defined time by varying the area of the opening and said defined time is predetermined so as to fill said ion storage device with a predetermined number of ions.

2. A mass spectrometer as claimed in claim 1, wherein said defined time is predetermined so as to fill said ion storage device for a predetermined length of time.

3. A mass spectrometer as claimed in claim 1, wherein at least one of said chambers is connected to a vacuum pump for maintaining the chambers at said different pressures.

4. A mass spectrometer as claimed in claim 1, wherein a high gas flow rate is permitted between the chambers when the area of the opening is large and a low gas flow rate is permitted between the chambers when the area of the opening is smaller.

5. A mass spectrometer as claimed in claim 1, wherein the mass spectrometer is configured to vary the area of the opening such that at a first time the area of the opening is set to permit gas to flow between the chambers, and at a second time the opening is closed so as to substantially prevent gas from passing between the chambers.

6. A mass spectrometer as claimed in claim 1, wherein the area of the opening is repeatedly increased and decreased.

7. A mass spectrometer as claimed in claim 1, further comprising an ion guide in one of the chambers which is arranged to guide or focus ions towards the opening so that they may pass through the opening and into the other chamber.

8. A mass spectrometer as claimed in claim 1, further comprising a second device for pulsing ions towards and through said opening, said second device being synchronised with the opening such that ions are pulsed through the opening when the opening is of relatively large area and ions are not pulsed through the opening when the opening is of relatively small area or is closed.

9. A mass spectrometer as claimed in claim 8, wherein said second device comprises a pulsed ion source.

10. A mass spectrometer as claimed in claim 1, wherein said two chambers are separated by a wall and said opening comprises an orifice in said wall.

11. A mass spectrometer as claimed in claim 1, wherein the opening comprises an orifice in a wall between the chambers and the mass spectrometer further comprises an orifice occlusion member, said orifice occlusion member being movable relative to the orifice so as to cover the orifice by varying amounts and thus change the area of said opening by corresponding varying amounts.

12. A mass spectrometer as claimed in claim 11, wherein said orifice occlusion member comprises at least one aperture and a non-apertured portion, and wherein said orifice occlusion member is arranged and adapted such that it is movable between a position where the aperture is relatively more aligned with the orifice so as to increase the area of the opening and a different position wherein the aperture less aligned with the orifice so as to decrease the area of the opening.

13. A mass spectrometer as claimed in claim 11, wherein said orifice occlusion member comprises at least one aperture and a non-apertured portion, and wherein said orifice occlusion member is arranged and adapted such that it is movable between a position where the non-apertured portion covers the orifice to close said opening, and a different position wherein the aperture is at least partially aligned with the orifice such that gas and/or ions can pass through the opening.

14. A mass spectrometer as claimed in claim 1, wherein the opening is provided by an iris, the opening in the iris being variable in diameter.

15. A mass spectrometer as claimed in claim 1, wherein the opening is provided by a deformable conduit and wherein the conduit is compressible or otherwise deformable so as to reduce the area of the opening through the conduit.

16. A method of controlling the gas flow between two chambers in a mass spectrometer that are maintained at different pressures, wherein the two chambers are interconnected by an opening for transmitting ions from one of the chambers to the other of the chambers, the method comprising:

varying the area of the opening so as to vary the gas flow rate through the opening and between the chambers to fill said ion storage device for a defined time which is predetermined so as to fill said ion storage device with a predetermined number of ions;

providing an ion storage device downstream of said opening;

transmitting ions through said opening into said ion storage device when the opening is of relatively large area; and preventing ions from being transmitted through said opening into said ion storage device when the opening has a relatively smaller area or is closed.

* * * * *